US011150006B2

(12) United States Patent
Guanye et al.

(10) Patent No.: US 11,150,006 B2
(45) Date of Patent: Oct. 19, 2021

(54) REFRIGERATOR

(71) Applicants: QINGDAO HAIER JOINT STOCK CO., LTD., Qingdao (CN); HAIER ASIA CO., LTD., Tokyo (JP)

(72) Inventors: Gongye Guanye, Tokyo (JP); Changzhi Fengdao, Tokyo (JP)

(73) Assignees: QINGDAO HAIER JOINT STOCK CO., LTD., Shandong Province (CN); HAIER ASIA CO., LTD., Tokyo (JP)

( * ) Notice: Subject to any disclaimer, the term of this patent is extended or adjusted under 35 U.S.C. 154(b) by 308 days.

(21) Appl. No.: 16/344,358

(22) PCT Filed: Feb. 23, 2017

(86) PCT No.: PCT/CN2017/074590
§ 371 (c)(1),
(2) Date: Apr. 23, 2019

(87) PCT Pub. No.: WO2018/076584
PCT Pub. Date: May 3, 2018

(65) Prior Publication Data

US 2019/0271497 A1 Sep. 5, 2019

(30) Foreign Application Priority Data

Oct. 24, 2016 (CN) ..... 201610937560.9

(51) Int. Cl.
*F25D 11/02* (2006.01)
*F25D 17/06* (2006.01)
(Continued)

(52) U.S. Cl.
CPC ..... *F25D 11/022* (2013.01); *F25B 5/00* (2013.01); *F25D 17/045* (2013.01);
(Continued)

(58) Field of Classification Search
CPC ..... F25D 11/02; F25D 11/022; F25D 17/045; F25D 17/065; F25D 21/004;
(Continued)

(56) References Cited

U.S. PATENT DOCUMENTS 4,711,098 A * 12/1987 Kuwabara ..... F25D 11/022 312/321.5
5,228,499 A * 7/1993 Yoon ..... F25D 17/065 165/263
(Continued)

FOREIGN PATENT DOCUMENTS

CN 1769823 A 5/2006
CN 101922838 A 12/2010
(Continued)

*Primary Examiner* — Jianying C Atkisson
*Assistant Examiner* — Miguel A Diaz
(74) *Attorney, Agent, or Firm* — Cheng-Ju Chiang

(57) ABSTRACT

A refrigerator comprises: a storage compartment, at least divided into a refrigerating compartment and a freezing compartment a first evaporator, arranged at a cooling compartment connected to the storage compartments through supply air ducts; a second evaporator, arranged inside the freezing compartment a switching valve, used to switch the flow of a refrigerant to a refrigerant channel connected to the second evaporator; a fan, used to enable cooled air in the first evaporator to flow from the cooling compartment to the storage compartments; a first air duct damper, inserted in the supply air duct connected to the refrigerating compartment and a second air duct damper, inserted in the supply air duct connected to the freezing compartment.

5 Claims, 7 Drawing Sheets

(51) Int. Cl.

| | |
|---|---|
| ***F25D 21/00*** | (2006.01) |
| ***F25D 29/00*** | (2006.01) |
| ***F25B 5/00*** | (2006.01) |
| ***F25D 17/04*** | (2006.01) |
| ***F25D 21/04*** | (2006.01) |
| ***F25D 19/00*** | (2006.01) |

(52) U.S. Cl.
CPC ..... *F25D 17/065* (2013.01); *F25D 19/003* (2013.01); *F25D 21/004* (2013.01); *F25D 21/04* (2013.01); *F25D 29/003* (2013.01); *F25B 2347/021* (2013.01); *F25B 2400/0409* (2013.01); *F25B 2600/2511* (2013.01); *F25B 2700/151* (2013.01); *F25D 2600/06* (2013.01); *F25D 2700/02* (2013.01); *F25D 2700/12* (2013.01); *F25D 2700/122* (2013.01); *F25D 2700/14* (2013.01)

(58) Field of Classification Search
CPC ..... F25D 2700/12; F25D 2700/121; F25D 2700/123; F25B 5/00; F25B 5/02
See application file for complete search history.

(56) References Cited

U.S. PATENT DOCUMENTS 5,392,615 A * 2/1995 Lim ..... F25D 17/065 62/414
5,735,138 A * 4/1998 Park ..... F25D 17/045 62/455
6,327,867 B1 * 12/2001 Hyodo ..... F25D 17/065 62/187
6,725,680 B1 * 4/2004 Schenk ..... F25D 11/02 62/186
6,923,015 B2 * 8/2005 Ueno ..... A61L 9/16 422/121
7,216,493 B2 * 5/2007 Hu ..... F25D 23/006 62/77
7,703,293 B2 * 4/2010 An ..... F25D 23/069 62/179
8,191,382 B2 * 6/2012 Lim ..... D06F 29/00 62/441
8,769,975 B2 * 7/2014 Lee ..... F25B 5/00 62/199
10,429,118 B2 * 10/2019 Ko ..... F25D 17/04
10,935,303 B2 * 3/2021 Lee ..... F25D 17/08
2006/0032264 A1 * 2/2006 Shim ..... F25D 17/045 62/408
2006/0130518 A1 * 6/2006 Kang ..... F25B 39/02 62/525
2006/0230782 A1 * 10/2006 Imai ..... F25B 1/10 62/512
2006/0266075 A1 * 11/2006 Itsuki ..... F25B 40/00 62/512
2008/0156034 A1 * 7/2008 Cur ..... F25D 11/02 62/449
2008/0314054 A1 * 12/2008 An ..... F25D 17/065 62/179
2009/0113923 A1 * 5/2009 Young ..... F25D 17/065 62/441
2009/0133432 A1 * 5/2009 Lee ..... D06F 31/00 62/441
2010/0162747 A1 * 7/2010 Hamel ..... F25D 17/065 62/441
2014/0260409 A1 * 9/2014 Junge ..... F25D 29/003 62/419
2017/0248348 A1 * 8/2017 Kim ..... F25D 17/065
2019/0003758 A1 * 1/2019 Scalf ..... F25D 17/045
2019/0011158 A1 * 1/2019 Sul ..... F25D 17/065
2019/0271497 A1 * 9/2019 Guanye ..... F25D 29/003
2019/0301786 A1 * 10/2019 Lee ..... F25B 5/02
2020/0340730 A1 * 10/2020 Kawanami ..... F25D 17/067

FOREIGN PATENT DOCUMENTS

| | | | |
|---|---|---|---|
| CN | 102226621 | A | 10/2011 |
| CN | 203036943 | U | 7/2013 |
| CN | 204027133 | U | 12/2014 |
| CN | 105466106 | A | 4/2016 |
| CN | 105928290 | A | 9/2016 |
| CN | 106091540 | A | 11/2016 |
| CN | 106123445 | A | 11/2016 |
| JP | S59-197778 | A | 11/1984 |
| JP | H11-173729 | A | 7/1999 |
| JP | 2008-249292 | A | 10/2008 |
| JP | 2009-198079 | A | 9/2009 |
| JP | 2011-58689 | A | 3/2011 |
| KR | 2002-0078094 | A | 10/2002 |
| WO | 2007/074125 | A1 | 7/2007 |

* cited by examiner

REFRIGERATOR

The present application is a 35 U.S.C. § 371 National Phase conversion of International (PCT) Patent Application No. PCT/CN2017/074590, filed on Feb. 23, 2017, which claims priority to Chinese Patent Application No. 201610937560.9, filed on Oct. 24, 2016 and titled "Refrigerator", which is incorporated herein by reference in its entirety. The PCT International Patent Application was filed and published in Chinese.

TECHNICAL FIELD

The present invention relates to a refrigerator that stores food and the like by refrigeration in a storage compartment, and in particular, to a refrigerator having a forced circulation evaporator and a direct cooling evaporator.

BACKGROUND

Among conventional refrigerators, there is a refrigerator in which cooled air obtained by an evaporator is forced to circulate in a storage compartment (for example, the patent document of Japanese Patent Publication No. 2011-58689 (Pages 6 and 7, FIG. 2)). In such a refrigerator, the evaporator is arranged inside a cooling compartment spaced apart from a storage compartment. Cooled air obtained from the evaporator is blown out by a fan and is supplied by a supply air duct into the storage compartment. The storage compartment is usually divided into a plurality of compartments for storing such as a refrigerating compartment and a freezing compartment. An amount of cold air supplied to each compartment is controlled by opening/closing an air door or the like disposed on the supply air duct. In addition, an electrical heater or the like is used to perform heating to melt frost on the evaporator, or the refrigerator is turned off to perform defrosting, or hot air is used to perform defrosting.

In addition, a well-known direct cooling refrigerator does not have a fan that forces cold air to circulate. Instead, natural convection of cold air obtained after heat exchange with an evaporator is directly used to cool the interior of a storage compartment (for example, the patent document of Japanese Patent Publication No. 2009-198079 (Page 3, FIG. 1)). In such a refrigerator, the evaporator used to cool the storage compartment is arranged inside a thermally insulated box that forms a wall surface of the storage compartment and inside the storage compartment.

However, the foregoing conventional refrigerators may be further improved in terms of reducing energy consumption, further saving energy, and maintaining food quality.

Specifically, as discussed in the patent document of Japanese Patent Publication No. 2011-58689, a conventional forced circulation refrigerator has the following problems. That is, a relatively large amount of frost is formed on an evaporator, and more frequent defrosting is required. When defrosting is performed to melt frost on the evaporator, an electrical heater or the like consumes power to work. In addition, the temperature in a storage compartment rises as defrosting continues. As a result, a cooling load increases, and more power needs to be consumed to cool the storage compartment. Therefore, to save energy, frost needs to be prevented from forming on the evaporator to reduce the frequency of defrosting.

In addition, in the forced circulation refrigerator, a lot of moisture in the storage compartment turns into a significant amount of frost on the evaporator, and therefore the air in the storage compartment becomes excessively dry. Food or the like in such a storage compartment with excessively dry air turns dry and so-called freezer burn occurs, resulting in the degradation of the quality of the food. Therefore, the forced circulation refrigerator is not a preferred solution.

In addition, as discussed in the patent document of Japanese Patent Publication No. 2009-198079, compared with the forced circulation refrigerator, in a conventional direct cooling refrigerator, a relatively small amount of frost accumulates on an evaporator, and the air in a storage compartment is not excessively dry. However, among other problems, it is difficult to defrost the evaporator.

To be specific, in a direct cooling refrigerator in which an evaporator is arranged on the circumferential wall of a storage compartment or is arranged inside the storage compartment, if the temperature of the evaporator is increased to melt frost, the temperature in the storage compartment tends to rise. Therefore, a cooling load is increased after defrosting, and more power is accordingly consumed.

In addition, if the temperature in a freezing compartment rises, a temperature change in the freezing compartment increases. There is accordingly an increased temperature difference between frozen food and surrounding air, causing a water vapor pressure difference. As a result, ice sublimes and food turns dry, and so-called freezer burn occurs. In addition, another problem is that due to a drastic temperature change, food is defrosted and refrozen, and relatively large ice is formed inside the food to damage food cells.

In addition, in the direct cooling refrigerator, in addition to a defrosting electrical heater or the like used to heat an evaporator, an electrical heater or the like is further used to prevent water produced by defrosting from being refrozen in the storage compartment. Such an electrical heater or the like used to prevent freezing consumes power and further increases a cooling load, and as a result, more power is consumed to perform cooling.

SUMMARY

To solve at least one of the foregoing technical problems, the objective of the present invention is to provide a refrigerator that saves energy efficiently and can keep the air in a storage compartment from becoming excessively dry, reduce the frequency of defrosting, and reduce power consumption.

To achieve the inventive objective, an embodiment of the present invention provides a refrigerator, comprising: a storage compartment, at least divided into a refrigerating compartment and a freezing compartment; a first evaporator, arranged at a cooling compartment, the cooling compartment being connected to the storage compartment through supply air ducts; a second evaporator, arranged inside the freezing compartment; a switching valve, used to switch the flow of a refrigerant to a refrigerant channel connected to the second evaporator; a fan, used to enable cooled air obtained from the first evaporator to flow from the cooling compartment to the storage compartment; a first air duct damper, inserted in the supply air duct connected to the refrigerating compartment; and a second air duct damper, inserted in the supply air duct connected to the freezing compartment.

As a further improvement of an embodiment of the present invention, the refrigerator comprises: a first refrigerant channel, sequentially connecting the switching valve, a first adjustor, and the first evaporator; and a second refrigerant channel, sequentially connecting the switching valve, a second adjustor, the second evaporator, and the first evaporator, wherein the switching valve is used to connect a refrigerant channel on an outlet side of a condenser to the first refrigerant channel or the second refrigerant channel.

As a further improvement of an embodiment of the present invention, the refrigerator comprises a load detector, used to detect a cooling load of the storage compartment, and when the cooling load detected by the load detector is less than a specific value, the switching valve is switched to enable a refrigerant to flow to the second evaporator to execute a direct cooling operation of a freezing compartment.

As a further improvement of an embodiment of the present invention, during the direct cooling operation of the freezing compartment, the fan is stopped, and the second air duct damper is closed.

As a further improvement of an embodiment of the present invention, during the direct cooling operation of the freezing compartment, the fan is stopped, and the fan is then operated again and the second air duct damper is opened after the second air duct damper has been closed for a given time length.

Compared with the prior art, the present invention has the following beneficial technical effects.

The refrigerator according to the present invention comprises: a first forced circulation evaporator, arranged at a cooling compartment; a second direct cooling evaporator, arranged inside a freezing compartment; a switching valve, used to switch between refrigerant channels; a first air duct damper, inserted in a supply air duct connected to a refrigerating compartment; and a second air duct damper, inserted in a supply air duct connected to the freezing compartment.

In this way, the switching valve is switched and the first air duct damper and the second air duct damper are respectively opened or closed to implement forced circulation cooling of the refrigerating compartment and switching between forced circulation cooling and direct cooling of the freezing compartment. As a result, the frequency of defrosting can be reduced, and energy is saved.

Specifically, the switching valve is switched to enable a refrigerant to flow to the second evaporator, the second air duct damper connected to the freezing compartment is closed, and a compressor is operated, so that the freezing compartment can be cooled by using the second evaporator without operating a fan.

In this way, frost on the first evaporator can be reduced, and the air in the freezing compartment is prevented from becoming excessively dry, so that the frequency of performing defrosting is reduced as compared with a conventional forced circulation refrigerator. As a result, food in the freezing compartment can be prevented from becoming dry while less power needs to be consumed for defrosting. Moreover, the power consumption of the fan can be reduced.

In addition, the switching valve is switched to enable a refrigerant to flow to the first evaporator, the second air duct damper connected to the freezing compartment is opened, and the compressor and the fan are operated, so that the freezing compartment can be cooled by using the first evaporator.

In this way, frost can be formed on the first evaporator, so that frost on the second evaporator is reduced, and the frequency of defrosting the second evaporator is reduced as compared with a conventional direct cooling refrigerator. As a result, the temperature rise in the freezing compartment can be suppressed while less power needs to be consumed for defrosting, so that food stored in the freezing compartment can maintain desirable quality for a long time.

In addition, the fan is operated, and the first air duct damper is opened, so that the refrigerating compartment may be cooled as frost on the first evaporator absorbs heat to melt, and water from the frost also humidifies the air in the refrigerating compartment. In this way, food in the refrigerating compartment can be prevented from becoming dry while energy-saving and efficient cooling is implemented, so that the quality of the food is maintained.

In addition, according to the refrigerator provided by the present invention, a freezing circulation loop is provided with: a first refrigerant channel, sequentially connecting the switching valve, a first adjustor, and the first evaporator; and a second refrigerant channel, sequentially connecting the switching valve, a second adjustor, the second evaporator, and the first evaporator. The switching valve may perform switching to connect a refrigerant channel on an outlet side of a condenser to a side of the first refrigerant channel or the second refrigerant channel.

The switching valve is switched to the first refrigerant channel, so that a refrigerant may only flow to the first evaporator to cool the storage compartment. That is, the refrigerating compartment and the freezing compartment can be separately cooled to suitable temperatures while frost is prevented from forming on the second evaporator.

In another aspect, the switching valve is switched to the second refrigerant channel, so that the first evaporator may be connected to the second evaporator in series. In this way, circulating air is cooled by using the first evaporator and then dehumidification while the freezing compartment is directly cooled by using the second evaporator. As a result, the first evaporator and the second evaporator are combined to cool the freezing compartment effectively while frost can be prevented from forming on the second evaporator.

In addition, when the second refrigerant channel is used, a refrigerant flowing out of the second evaporator flows to the first evaporator, and therefore a remaining liquid-state refrigerant may be stored in the first evaporator. In this way, the liquid-state refrigerant can be prevented from flowing back to the compressor, so that the volume of content in a liquid reservoir or the like can be reduced.

In addition, according to the refrigerator provided by the present invention, a load detector is disposed to detect a cooling load of the storage compartment. When the cooling load detected by the load detector is less than a specific value, the switching valve is switched to enable a refrigerant to flow to the second evaporator to execute a direct cooling operation of the freezing compartment. In this way, the freezing compartment can be efficiently cooled by using the second evaporator while the air in the freezing compartment is prevented from becoming dry. In addition, frost formed on the second evaporator can be reduced to the great extent.

In addition, according to the refrigerator provided by the present invention, during the direct cooling operation of the freezing compartment, the fan is stopped, and the second air duct damper is closed, so that forced circulation may be stopped and the freezing compartment is cooled only by using the second evaporator. In this way, the freezing compartment can be cooled more effectively while the air in the freezing compartment is prevented from becoming dry.

In addition, according to the refrigerator provided by the present invention, during the direct cooling operation of the freezing compartment, the fan is stopped, and the fan is then operated again and the second air duct damper is opened after the second air duct damper has been closed for a given time length. In this way, during the direct cooling operation of the freezing compartment, air may be forced to circulate between the freezing compartment and the cooling compartment, so that frost is formed on the first evaporator. As a result, frost can be prevented from forming on the second evaporator. In addition, water recycled from the first evaporator can be used to humidify the air in the refrigerating compartment.

DETAILED DESCRIPTION

A refrigerator shown in accordance with an embodiment of the present invention is described below in detail with reference to the accompanying drawings.

Figure 1:
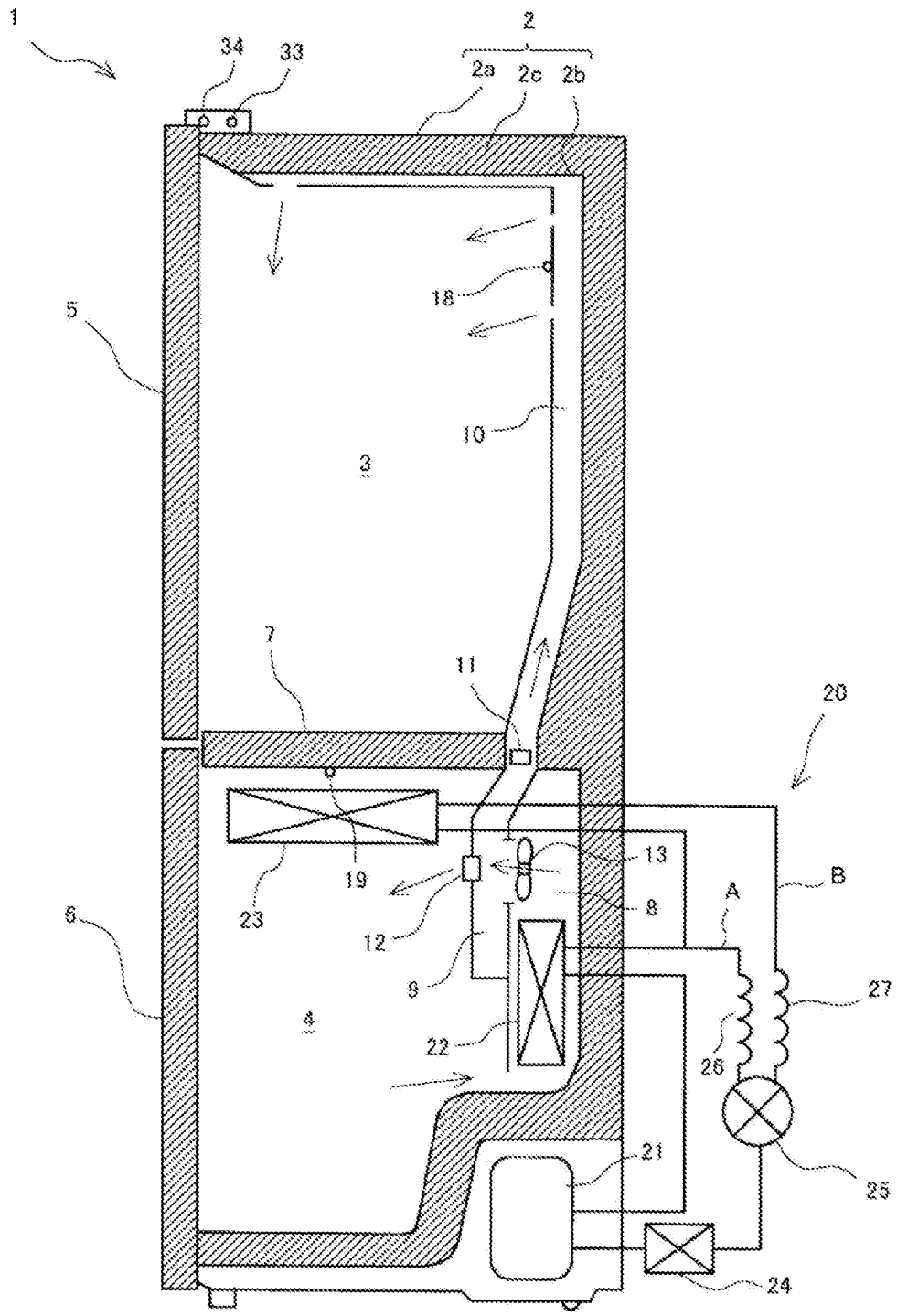
FIG. 1 is a brief structural diagram of a refrigerator shown in accordance with an embodiment of the present invention.

FIG. 1 is a brief structural diagram of a refrigerator 1 shown in accordance with this embodiment. In FIG. 1, a brief side sectional view of the refrigerator 1 is overlapped with a brief view of a freezing circulation loop 20. As shown in FIG. 1, the refrigerator 1 uses a thermally insulated box 2 as a main body. A storage compartment used to store food or the like is disposed inside the thermally insulated box 2.

The interior of the storage compartment is divided into two compartments having different storage temperatures, namely, a refrigerating compartment 3 in a refrigerating temperature range and a freezing compartment 4 in a freezing temperature range. The refrigerating compartment 3 and the freezing compartment 4 below are separated by a thermally insulated partition wall 7. A shelf (not shown), a holding container (not shown) and the like are disposed inside the refrigerating compartment 3 and the freezing compartment 4 and used to store food or the like.

As the main body of the refrigerator 1, the structure of the thermally insulated box 2 comprises: an outer box 2*a*, made of steel plates, openings being provided in the front; an inner box 2*b*, made of synthetic resin and arranged in the outer box 2*a*, a gap being kept between the inner box 2*b* and the outer box 2*a*; and a thermal insulation material 2*c*, made of polyurethane foam, and foamed and filled in the gap between the outer box 2*a* and the inner box 2*b*.

The openings are provided in the front of the thermally insulated box 2. The openings correspond to the refrigerating compartment 3 and the freezing compartment 4 respectively. Thermally insulated doors 5 and 6 that can be freely opened or closed are respectively disposed on the openings. In addition, holding baskets may be arranged on inner box sides of the doors 5 and 6. In addition, a door open/close sensor 34 is disposed on the refrigerator 1 and used to detect the opening or closing of the doors 5 and 6.

In addition, the storage compartment may be divided in more detail. For example, other compartments for storing such as an ice making compartment and a fruit and vegetable compartment are arranged. A plurality of doors that corresponds to the compartments respectively is arranged. In addition, holding containers or the like that can be pulled out together with the doors may further be arranged in the compartments.

The rear and the top of the refrigerating compartment 3 form a supply air duct 10 used to guide air cooled by a first evaporator 22 as described below into the refrigerating compartment 3. The supply air duct 10 is a space formed between a partition body that constitutes the rear of the refrigerating compartment 3 and is made of synthetic resin and the inner box 2*b* of the thermally insulated box 2. An air outlet is provided in the partition body and is used to supply the interior of the refrigerating compartment 3 with cold air flowing into the supply air duct 10.

A supply air duct 9 is disposed on the rear of the freezing compartment 4 and is connected to the freezing compartment 4 and the supply air duct 10. The supply air duct 9 and the freezing compartment 4 are separated by the partition body made of synthetic resin. In addition, the air outlet is provided in the partition body. Cold air flows to the freezing compartment 4 through the air outlet. A freezing air door 12 (hereinafter referred to as "the F air door 12") used as a second air duct damper is disposed on the air outlet.

In addition, a refrigerating air door 11 (hereinafter referred to as "the R air door 11") used as a first air duct damper is disposed on the supply air duct 10 connected to the refrigerating compartment 3. That is, the supply air duct 9 and the supply air duct 10 are connected through the R air door 11.

The R air door 11 and the F air door 12 are electric air doors. The electric air door is formed of a plate body and a driving motor. The plate body is an axially supported open/close cover with one freely rotatable side. Further, the first air duct damper or the second air duct damper are not limited to these, and may be, for example, open/close apparatuses in other forms such as slide open/close boards.

When the R air door 11 is opened or closed, air may be adjusted to flow or not to flow from the supply air duct 9 to the supply air duct 10. In addition, a suitable open/close action of adjusting the R air door 11 may be used to adjust the flow of cold air supplied to the refrigerating compartment 3.

In addition, when the F air door 12 is opened or closed, air may be adjusted to flow or not to flow from the supply air duct 9 to the freezing compartment 4. A suitable open/close action of adjusting the F air door 12 may be used to adjust the flow of cold air supplied to the freezing compartment 4.

On a bottom side of the supply air duct 9, a cooling compartment 8 is disposed inside the thermally insulated box 2. The cooling compartment 8 and the supply air duct 9 are separated by a partition body made of synthetic resin. The first evaporator 22 is disposed inside the cooling compartment 8 and used to cool air that circulates in the cooling compartment. A detailed description of the first evaporator 22 will be described later.

In addition, a defrosting heater (not shown) is disposed below the first evaporator 22 inside the cooling compartment 8. As a defrosting unit, the defrosting heater is used to melt and remove frost on the first evaporator 22. In addition, a return opening is provided below the cooling compartment 8 and used for air to return from the freezing compartment 4 to the cooling compartment 8.

An opening connected to the supply air duct 9 is provided above the cooling compartment 8 and is used as an air supply opening. A fan 13 is mounted at the air supply opening and is used to enable cold air to circulate. That is, under the effect of the fan 13, cooled air obtained from the first evaporator 22 flows from the cooling compartment 8 to the storage compartment. The fan 13 is an axial-flow fan and comprises a rotatable propeller fan; a fan motor (not shown); and a sleeve tube (not shown) having an air hole. In addition, the fan 13 may further be, for example, a combination of a motor and a propeller fan that does not comprise a sleeve tube, or a fan in another form, for example, a multi-blade fan.

A refrigerating compartment temperature sensor 18 (hereinafter referred to as "the R sensor 18") is disposed inside the refrigerating compartment 3 and used to detect the temperature in the refrigerating compartment 3. A freezing compartment temperature sensor 19 (hereinafter referred to as "the F sensor 19") is disposed inside the freezing compartment 4 and used to detect the temperature in the freezing compartment 4. In addition, the mounting positions of the R sensor 18 and the F sensor 19 are not limited to the positions in FIG. 1. In addition, the refrigerator 1 is further provided with an external temperature sensor 33 which is used to detect the temperature outside the refrigerator.

As a refrigerating unit, the refrigerator 1 is provided with a vapor compression type freezing circulation loop 20. The freezing circulation loop 20 comprises: a compressor 21, used to compress a refrigerant; and a condenser 24 in which the compressed high-temperature high-pressure refrigerant exchanges heat with external air to enable the refrigerant to condense. A radiator fan (not shown) or the like used to deliver air locally to the compressor 21 and the condenser 24 and deliver air to the condenser 24 is arranged in a machine compartment located on a bottom side below the refrigerator 1. In addition, the refrigerant used in the freezing circulation loop 20 of the refrigerator 1 is isobutane (R600a).

In addition, the freezing circulation loop 20 comprises: the first evaporator 22, arranged inside the cooling compartment 8, and used to perform forced circulation cooling; and a second evaporator 23, arranged inside the freezing compartment 4, and used to perform direct cooling.

The first evaporator 22 is, for example, a finned tube heat exchanger having a refrigerant flow path inside a heat exchanger tube. The refrigerant flowing through the first evaporator 22 exchanges heat with air flowing through the cooling compartment 8 to evaporate. In this way, the air flowing through the cooling compartment 8 is cooled. The obtained cooled air is supplied to the refrigerating compartment 3 and the freezing compartment 4. In addition, the first evaporator 22 may be a heat exchanger in another form, for example, a heat exchanger using a flat porous tube and an irregularly-shaped tube.

The second evaporator 23 may be, for example, any of a variety of heat exchangers having a refrigerant flow path inside a heat exchanger tube, and a finned tube, a metal wire for promoting heat transfer, and the like outside the heat exchanger tube. In addition, the second evaporator 23 may be alternatively a welded plate heat exchanger in which a pair of steel plates is attached together and a refrigerant flow path is formed between the steel plates. The refrigerant flowing through the second evaporator 23 exchanges heat with air in the freezing compartment 4 and is then evaporated. In this way, the freezing compartment 4 is cooled.

A first adjustor 26 and a second adjustor 27 are connected respectively to the first evaporator 22 and the second evaporator 23 and used to compress and expand the high-pressure liquid-state refrigerant. A three-way valve 25 is disposed on an upstream side of the first adjustor 26 and the second adjustor 27 and is used as a switching valve to switch between refrigerant channels, so as to make a selection on whether or not a refrigerant flows into a refrigerant channel (a second refrigerant channel B) connected to the second evaporator 23.

To be specific, the freezing circulation loop 20 comprises: a first refrigerant channel A, sequentially connecting the three-way valve 25, the first adjustor 26, and the first evaporator 22; and the second refrigerant channel B, sequentially connecting the three-way valve 25, the second adjustor 27, the second evaporator 23, and the first evaporator 22. In addition, the three-way valve 25 may perform switching to connect a refrigerant channel on an outlet side of the condenser 24 to a side of the first refrigerant channel A or the second refrigerant channel B. In addition, the three-way valve 25 may close both the first refrigerant channel A and the second refrigerant channel B.

Here, the first adjustor 26 and the second adjustor 27 may adopt, for example, capillary tubes or electronic expansion valves. When the electronic expansion valves that can completely close the first adjustor 26 and the second adjustor 27 respectively are used, one of the first adjustor 26 and the second adjustor 27 may also be selected and kept open, so that the three-way valve 25 is omitted. That is, the electronic expansion valves in the form of the first adjustor 26 and the second adjustor 27 may be used as switching valves for switching between refrigerant channels. In addition, electromagnetic open/close valves or the like may be arranged on the first refrigerant channel A and the second refrigerant channel B respectively and used as the switching valves in place of the three-way valve 25.

Figure 2:
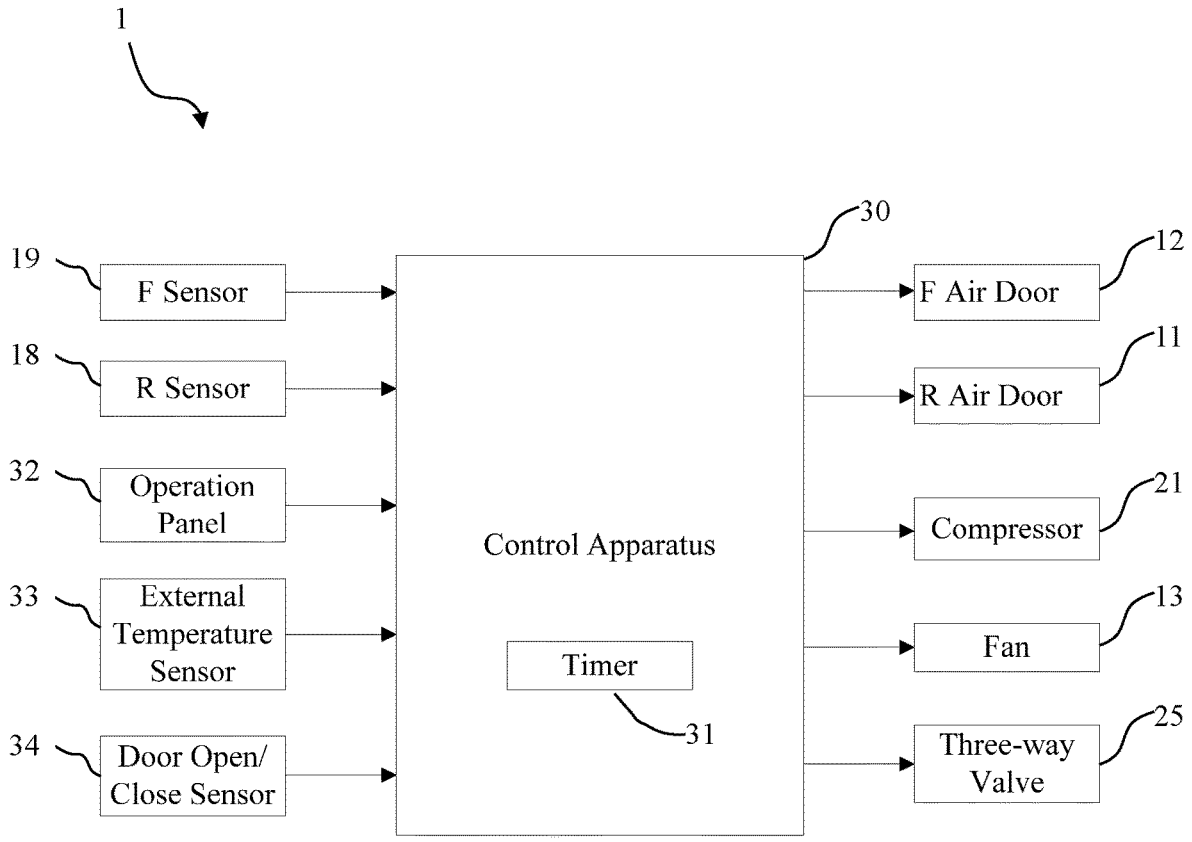
FIG. 2 is a block diagram of a control system of a refrigerator shown in accordance with an embodiment of the present invention.

FIG. 2 is a block diagram depicting a control system of the refrigerator 1. As shown in FIG. 2, a control apparatus 30 is disposed on the refrigerator 1 and used to control various constituent devices. As a control unit, the control apparatus 30 comprises a microprocessor used to perform specific operations and a timer 31 used to perform time operation.

The F sensor 19 used to detect the temperature in the freezing compartment 4 (referring to FIG. 1), the R sensor 18 used to detect the temperature in the refrigerating compartment 3 (referring to FIG. 1), an operation panel 32 used for a user to input various set values, the external temperature sensor 33 and the door open/close sensor 34 are all connected to an input side of the control apparatus 30.

The F sensor 19, the R sensor 18, the external temperature sensor 33, and the door open/close sensor 34 are load detectors of the control apparatus 30 and used to detect information required to calculate a cooling load. In addition, for other load detectors, the control apparatus 30 further has a function of detecting a load (current, voltage) of the compressor 21.

The F air door 12, the R air door 11, the compressor 21, the fan 13, and the three-way valve 25 are connected to an output side of the control apparatus 30. In addition, other sensor type devices and controlled devices that are not shown in the drawings are further connected to the control apparatus 30.

The control apparatus 30 performs specified operations according to inputs of the F sensor 19, the R sensor 18, the operation panel 32, the external temperature sensor 33, the door open/close sensor 34, and the like, so as to control the F air door 12, the R air door 11, the compressor 21, the fan 13, the three-way valve 25, and the like.

Next, referring to FIGS. 3 to 7, control actions of the refrigerator 1 shown in FIGS. 1 and 2 are described in detail.

Figure 3:
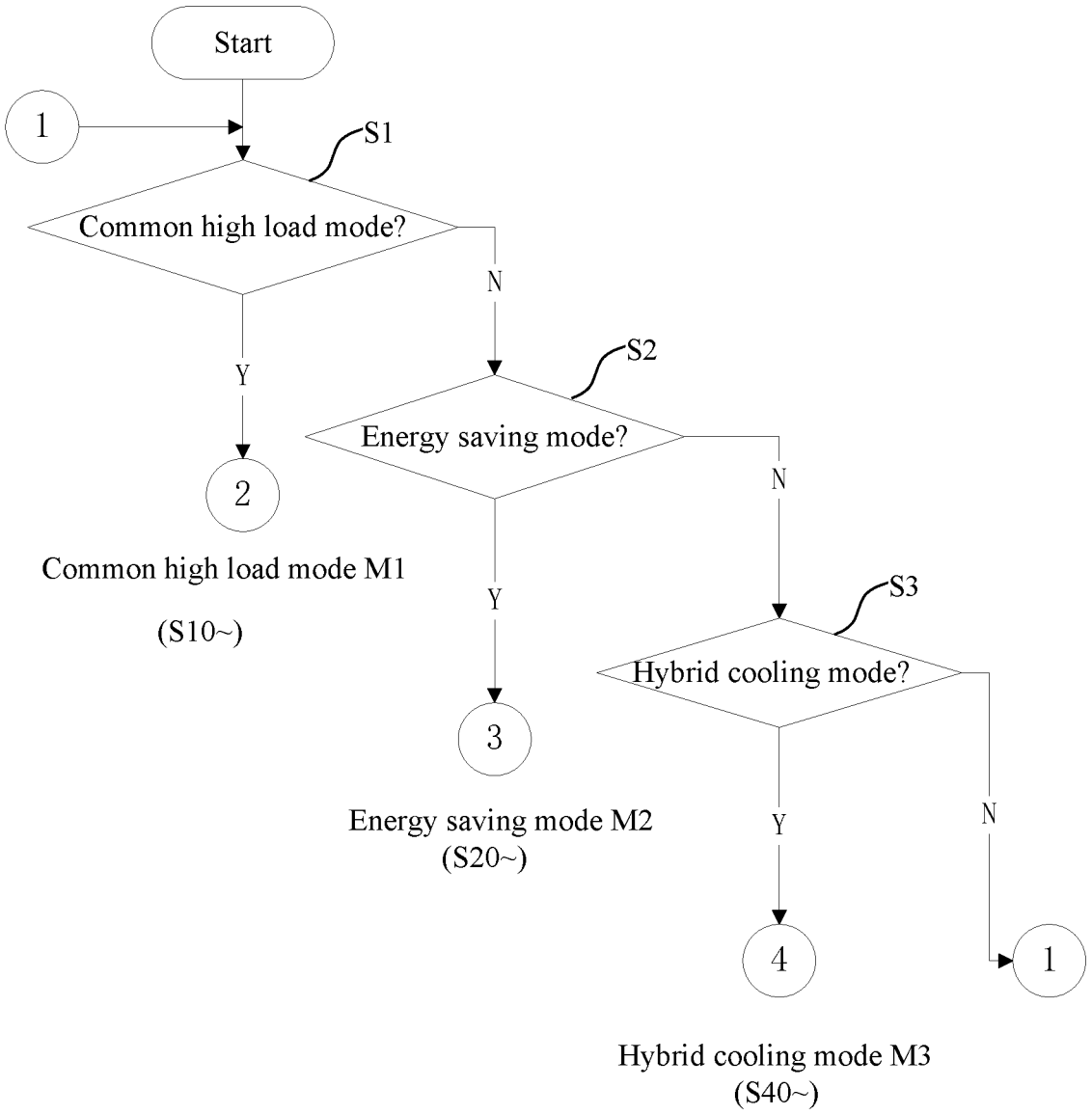
FIG. 3 is a control flow chart of controlling the operation of a refrigerator shown in accordance with an embodiment of the present invention.

FIG. 3 is a flow chart of controlling the refrigerator 1 to work and shows a control procedure related to operation mode selection.

As shown in FIG. 3, the control apparatus 30 (referring to FIG. 2) selects any one of a common high load mode M1, an energy saving mode M2, and a hybrid cooling mode M3. Specifically, first, the control apparatus 30 determines whether a necessary condition for the common high load mode M1 is satisfied (S1). If the necessary condition is satisfied (S1: yes), the common high load mode M1 is executed. If the necessary condition for the common high load mode M1 is not satisfied (S1: no), the control apparatus 30 determines whether to execute the energy saving mode M2 (S2). If a necessary condition for the energy saving mode M2 is satisfied (S2: yes), the energy saving mode M2 is executed. In another aspect, if the necessary condition for the energy saving mode M2 is not satisfied (S2: no), the control apparatus 30 determines whether to execute the hybrid cooling mode M3 (S3). If the necessary condition is satisfied (S3: yes), the control apparatus 30 selects the hybrid cooling mode M3. If the necessary condition is not satisfied (S3: no), the control apparatus 30 returns to step S1, and continues to select an operation mode.

Here, for example, a cooling load of the refrigerator 1 is used as a standard for selecting an operation mode. That is, if the cooling load is greater than or equal to a specified standard value (a first standard value) (S1: yes), the control apparatus 30 executes the common high load mode M1. In addition, if the cooling load is less than the first standard value but is greater than or equal to a specified standard value (a second standard value) that is less than the first standard value (S2: yes), the control apparatus 30 selects the energy saving mode M2. In another aspect, if the cooling load is less than the second standard value (S3: yes), the control apparatus 30 selects the hybrid cooling mode M3.

A cooling load value used as a reference to select an operation mode is obtained by performing specific operations according to: the temperature in the refrigerating compartment 3 detected by the R sensor 18 shown in FIG. 1 or FIG. 2; the temperature in the freezing compartment 4 detected by the F sensor 19; the external temperature detected by the external temperature sensor 33; the open/close states of the doors 5 and 6 detected by the door open/close sensor 34; a load of the compressor 21; and various set values input through the operation panel 32, and the like. In addition, the timer 31 and a learning function or the like of the control apparatus 30 may be used to store a change status of the cooling load to perform an operation of predicting the cooling load.

Figure 4:
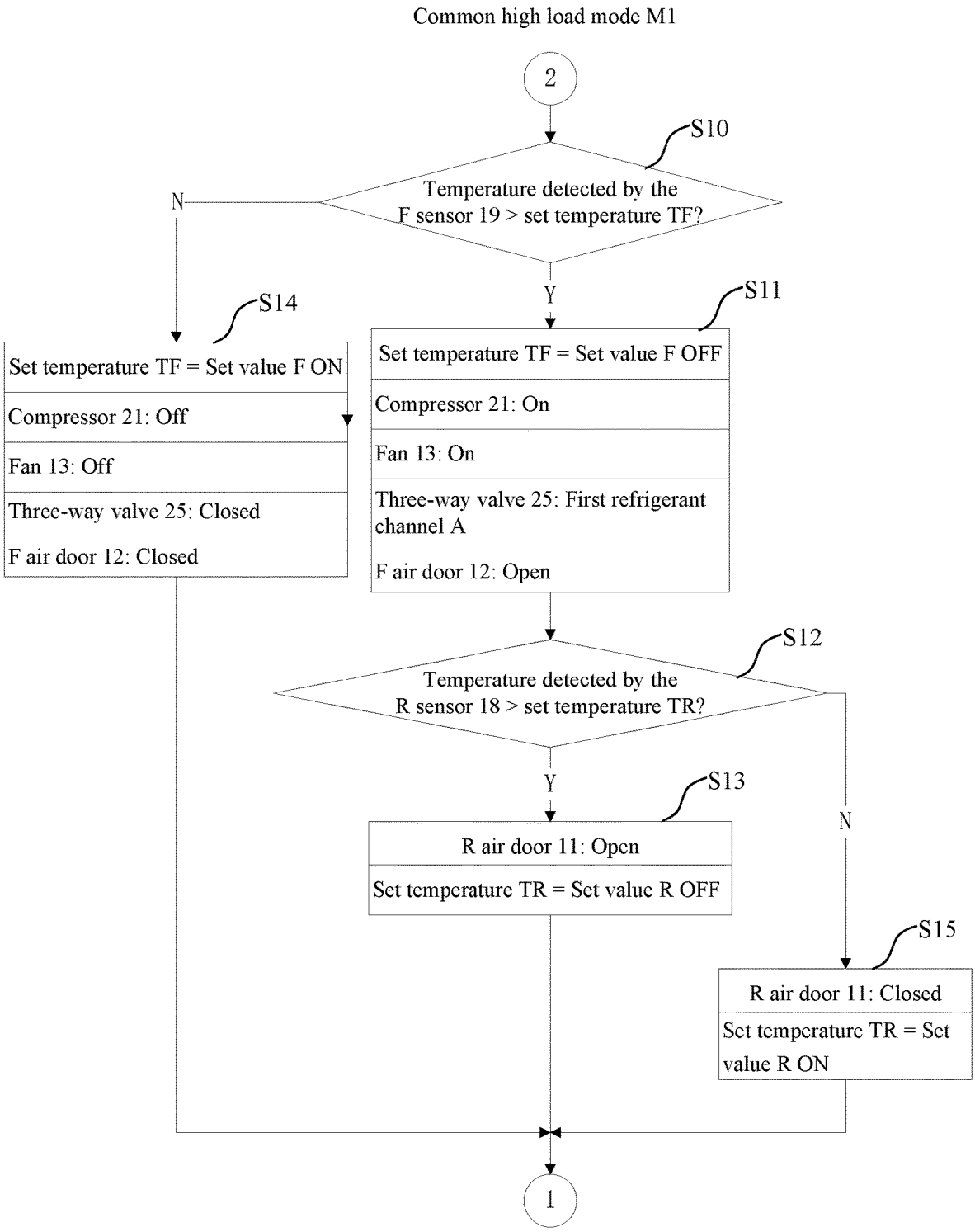
FIG. 4 is a control flow chart of controlling the operation of a refrigerator shown in accordance with an embodiment of the present invention.

Control actions in the common high load mode M1 are described below in detail. FIG. 4 is a flow chart of controlling the refrigerator 1 to work and shows a control procedure related to the common high load mode M1.

In the common high load mode M1, cooled air obtained from the first evaporator 22 shown in FIG. 1 is forced to circulate and used to cool the refrigerating compartment 3 and the freezing compartment 4. During cooling, the F air door 12 stays open, and the R air door 11 is opened or closed according to the temperature in the refrigerating compartment 3.

Specifically, as shown in FIG. 4, first, the control apparatus 30 (referring to FIG. 2) compares the temperature in the freezing compartment 4 detected by the F sensor 19 with a specified set temperature TF to determine whether to perform a cooling operation (S10).

Here, the set temperature TF is a standard temperature for determining to begin or end cooling of the freezing compartment 4. Specifically, a specified set value F ON may be input into the option of the set temperature TF and used as a standard for beginning cooling of the freezing compartment 4, or a specified set value F OFF may be input into the option of the set temperature TF and used as a standard for ending cooling of the freezing compartment 4. The set value F ON and the set value F OFF are standard temperatures that are determined according to a status of cooling load, the various set values that are input through the operation panel 32 (referring to FIG. 2), and the like. The value of the set value F ON is greater than that of the set value F OFF. For the option of the set temperature TF, the set value F ON and the set value F OFF are used, so that frequent switching between beginning cooling and ending cooling may be avoided, thereby implementing stable control.

In step S10, if the temperature in the freezing compartment 4 is higher than the set temperature TF (S10: yes), the control apparatus 30 inputs the set value F OFF to the option of the set temperature TF, operates the compressor 21 and the fan 13, switches the three-way valve 25 to the first refrigerant channel A, and opens the F air door 12 (S11).

In this way, a high-temperature high-pressure refrigerant compressed by the compressor 21 condenses and releases heat in the condenser 24 (referring to FIG. 1), and is then decompressed by the first adjustor 26 (referring to FIG. 1) and then compressed and expanded to flow into the first evaporator 22. In the first evaporator 22, the low-temperature liquid-state refrigerant evaporates. Air in the cooling compartment 8 exchanges heat with the refrigerant and is cooled. Subsequently, the obtained cooled air is blown out by the fan 13 and supplied to the freezing compartment 4. In addition, in step S11, the set value F OFF is input into the option of the set temperature TF, so that cooling work can be prevented from ending immediately after the compressor 21 and the fan 13 are operated.

Next, the control apparatus 30 compares the temperature in the refrigerating compartment 3 detected by the R sensor 18 with a specified the set temperature TR to determine whether the refrigerating compartment 3 needs to be cooled (S12).

Here, the set temperature TR is a standard temperature for determining to begin or end cooling of the refrigerating compartment 3. Specifically, a specified set value R ON may be input into the option of the set temperature TR and used as a standard for beginning cooling of the refrigerating compartment 3, or a specified set value R OFF may be input into the option of the set temperature TR and used as a standard for ending cooling of the refrigerating compartment 3. The set value R ON and the set value R OFF are standard temperatures that are determined according to a status of cooling load, various set values input through the operation panel 32, and the like. The set value R ON is greater than the set value R OFF. For the option of the set temperature TR, the set value R ON and the set value R OFF are used to set a constant difference between the standard for beginning cooling and the standard for ending cooling, so as to avoid frequent repeated operation and stop actions.

In step S12, if the temperature in the refrigerating compartment 3 is higher than the set temperature TR (S12: yes), the control apparatus 30 opens the R air door 11 and inputs the set value R OFF into the option of the set temperature TR (S13). After the R air door 11 is opened, the cooled air obtained from the first evaporator 22 flows into the refrigerating compartment 3 to cool the refrigerating compartment 3. In addition, the set value R OFF is input into the option of the set temperature TR, so that cooling of the refrigerating compartment 3 can be prevented from ending immediately after the R air door 11 is opened, thereby avoiding frequent repeated open/close actions of the R air door 11.

In another aspect, in step S12, if the temperature in the refrigerating compartment 3 is lower than or equal to the set temperature TR (S12: no), the control apparatus 30 closes the R air door 11, and inputs the set value R ON into the option of the set temperature TR (S15). In this way, supply of cold air to the refrigerating compartment is cut off. In addition, the set temperature TR is set to the standard temperature for beginning cooling of the refrigerating compartment 3, that is, the set value R ON.

In addition, in step S10, if the temperature in the freezing compartment 4 is lower than or equal to the set temperature TF (S10: no), the control apparatus 30 inputs the set value F ON into the option of the set temperature TF, stops the compressor 21 and the fan 13, closes the three-way valve 25, and closes the F air door 12 (S14). In this way, cooling work stops.

Figure 5:
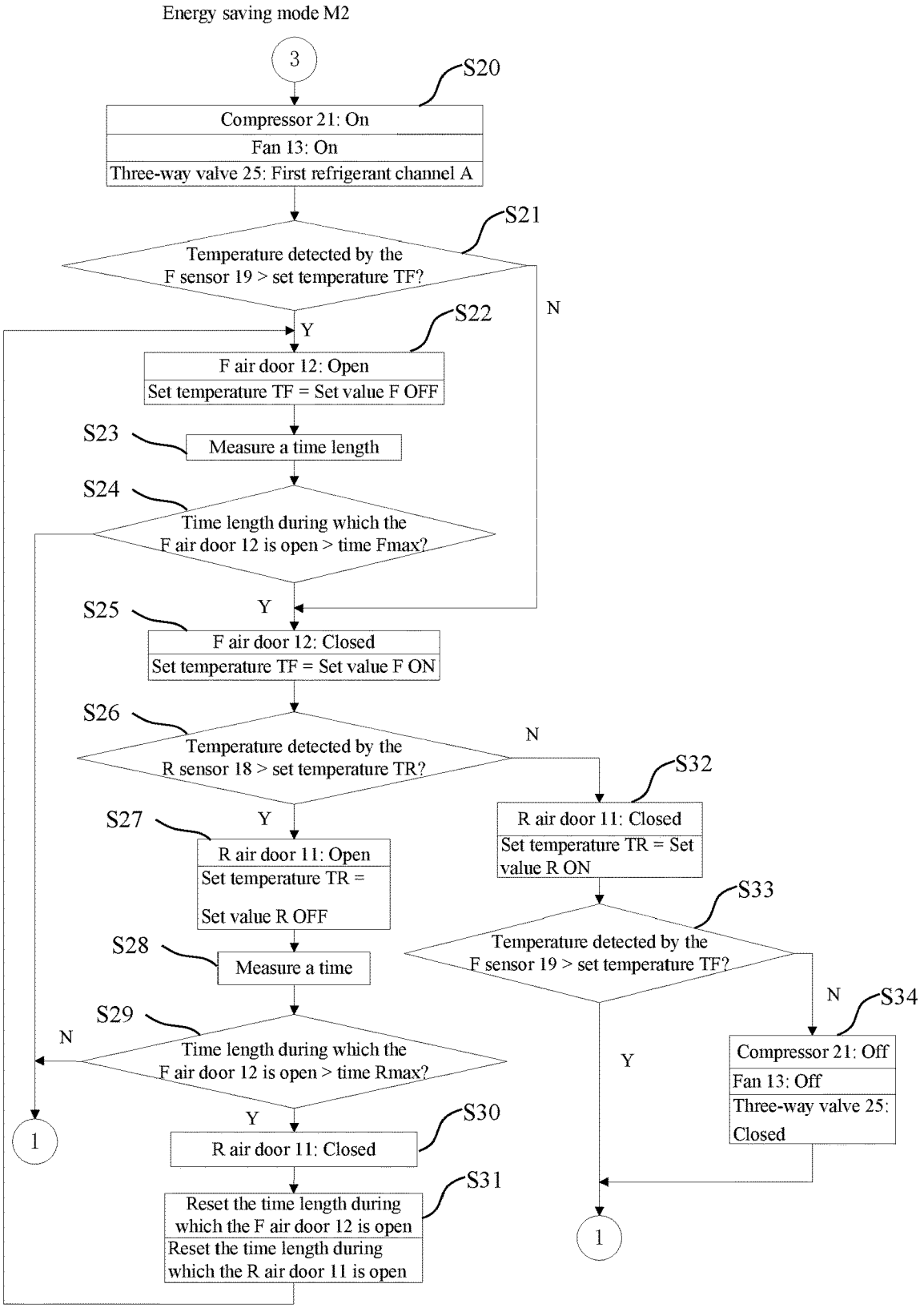
FIG. 5 is a control flow chart of controlling the operation of a refrigerator shown in accordance with an embodiment of the present invention.

Control actions in the energy saving mode M2 are described below in detail. FIG. 5 is a flow chart of controlling the refrigerator 1 to work and shows a control procedure related to the energy saving mode M2.

In the energy saving mode M2, cooled air obtained from the first evaporator 22 shown in FIG. 1 is forced to circulate and used to cool the refrigerating compartment 3 and the freezing compartment 4. The R air door 11 and the F air door 12 are respectively opened or closed according to the temperature of the refrigerating compartment 3 and the temperature in the freezing compartment 4.

Specifically, as shown in FIG. 5, first, the control apparatus 30 (referring to FIG. 2) operates the compressor 21 and the fan 13, and switches the three-way valve 25 to the first refrigerant channel A (S20). In this way, forced circulation cooling is performed by using the first evaporator 22.

The control apparatus 30 then compares the temperature in the freezing compartment 4 detected by the F sensor 19 with the set temperature TF to determine whether to cool the freezing compartment 4 (S21). If the temperature in the freezing compartment 4 is higher than the set temperature TF (S21: yes), the control apparatus 30 opens the F air door 12, and inputs the set value F OFF into the option of the set temperature TF. In this way, the cooled air obtained from the first evaporator 22 is supplied to the freezing compartment 4.

In another aspect, in step S21, if the temperature in the freezing compartment 4 is lower than or equal to the set temperature TF (S21: no), the control apparatus 30 closes the F air door 12, and inputs the set value F ON into the option of the set temperature TF (S25). After the F air door 12 is closed, cooling of the freezing compartment 4 stops.

In addition, when the temperature in the freezing compartment 4 is higher than the set temperature TF (S21: yes) and the freezing compartment 4 is being cooled (S22), the control apparatus 30 measures a cumulative time during which the F air door 12 is kept open (S23). The control apparatus 30 then determines whether the cumulative time during which the F air door 12 is kept open exceeds a specified upper limit value of keeping the F air door 12 open, that is, an F maximum cooling time (hereinafter referred to as "time Fmax") (S24).

When the cumulative time during which the F air door 12 is kept open exceeds the time Fmax (S24: yes), the control apparatus 30 closes the F air door 12, and inputs the set value F ON into the option of the set temperature TF (S25). After the F air door 12 is closed, supply of cold air to the freezing compartment 4 is stopped. That is, once the cumulative time during which the F air door 12 is kept open exceeds the time Fmax, the control apparatus 30 directly stops cooling the freezing compartment 4 and switches to a next cooling action regardless of the temperature in the freezing compartment 4.

In another aspect, when the cumulative time during which the F air door 12 is kept open does not exceed the time Fmax (S24: no), the control apparatus 30 returns to step S1 (referring to FIG. 3), and repeats the foregoing control actions. That is, if the cooling load is equal to the specified standard value (FIG. 3, S2: yes), and the temperature in the freezing compartment 4 is higher than the set temperature TF (S21: yes), forced circulation is used to continue to cool the freezing compartment 4.

Next, after cooling of the freezing compartment 4 stops (S25), the control apparatus 30 compares the temperature in the refrigerating compartment 3 detected by the R sensor 18 with the set temperature TR to determine whether the refrigerating compartment 3 needs to be cooled (S26). If the temperature in the refrigerating compartment 3 is higher than the set temperature TR (S26: yes), the control apparatus 30 opens the R air door 11, and inputs the set value R OFF into the option of the set temperature TR (S27). After the R air door 11 is opened, the cooled air obtained from the first evaporator 22 flows into the refrigerating compartment 3 to cool the refrigerating compartment 3.

The control apparatus 30 then measures a cumulative time during which the R air door 11 is kept open (S28), and further determines whether the cumulative time exceeds a specified upper limit value of keeping the R air door 11 open, that is, an R maximum cooling time (hereinafter referred to as "time Rmax") (S29).

When the cumulative time during which the R air door 11 is kept open exceeds the time Rmax (S29: yes), the control apparatus 30 closes the R air door 11 (S30), resets the cumulative time during which the R air door 11 is kept open and the cumulative time during which the F air door 12 is kept open (S31), then returns to step S22, and opens the F air door 12.

That is, once the cumulative time during which the R air door 11 is kept open exceeds the time Rmax, the control apparatus 30 directly stops cooling the refrigerating compartment 3 and switches to cool the freezing compartment 4 regardless of the temperature in the refrigerating compartment 3. In this way, through switching, the cooled air obtained from the first evaporator 22 is alternately supplied to the refrigerating compartment 3 and the freezing compartment 4 according to the specified time (the time Fmax, and the time Rmax).

In another aspect, in step S29, when the cumulative time during which the R air door 11 is kept open does not exceed the time Rmax (S29: no), the control apparatus 30 returns to step S1, and repeats the foregoing control actions, so that the refrigerating compartment 3 continues to be cooled by forced circulation.

In addition, in step S26, if the temperature in the refrigerating compartment 3 is lower than or equal to the set temperature TR (S26: no), the control apparatus 30 closes the R air door 11, and inputs the set value R ON into the option of the set temperature TR (S32). In this way, supply of cold air to the refrigerating compartment 3 is cut off.

The control apparatus 30 then compares the temperature in the freezing compartment 4 detected by the F sensor 19 with the set temperature TF (S33), and if the temperature in the freezing compartment 4 is higher than the set temperature TF (S33: yes), returns to step S1 and repeats the foregoing control actions.

In another aspect, if the temperature in the freezing compartment 4 is lower than or equal to the set temperature TF (S33: no), the control apparatus 30 stops the compressor 21 and the fan 13, and closes the three-way valve 25. In this way, cooling work stops. The control apparatus 30 then returns to the action in step S1.

Figure 6:
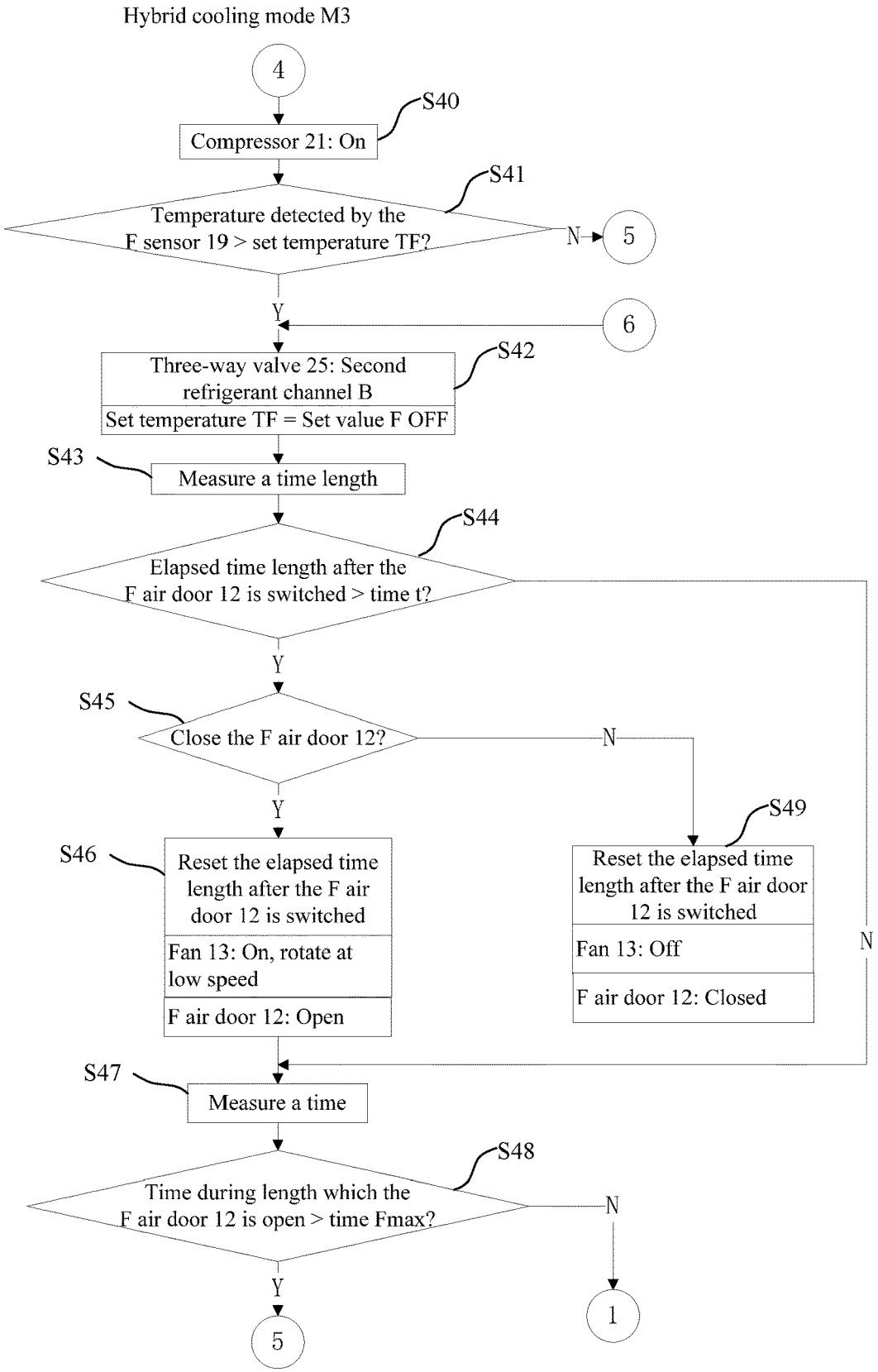
FIG. 6 is a control flow chart of controlling the operation of a refrigerator shown in accordance with an embodiment of the present invention.
Figure 7:
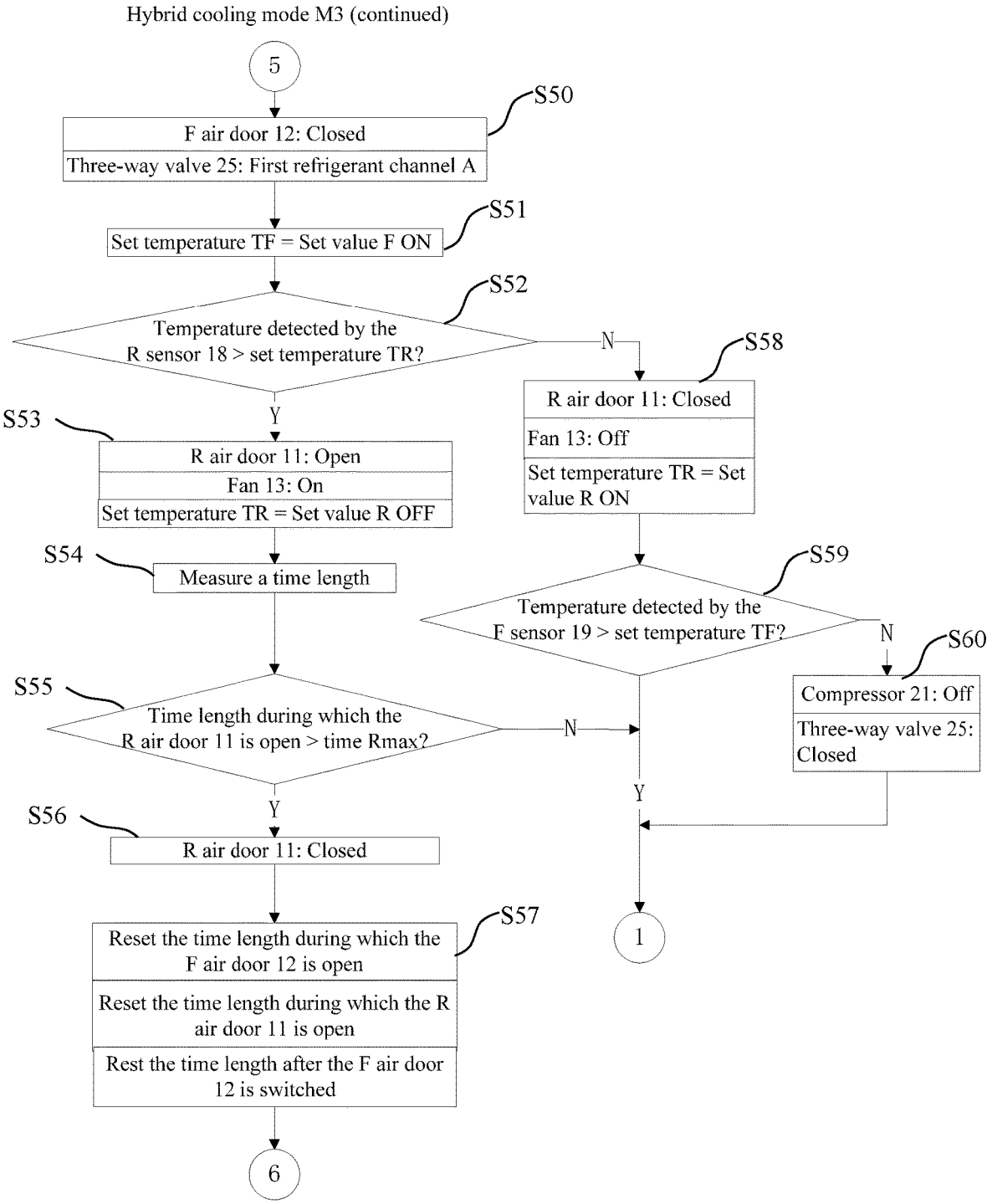
FIG. 7 is a control flow chart of controlling the operation of a refrigerator shown in accordance with an embodiment of the present invention.

Control actions in the hybrid cooling mode M3 are described below in detail. FIGS. 6 and 7 are a flow chart of controlling the refrigerator 1 to work and show a control procedure related to the hybrid cooling mode M3.

In the hybrid cooling mode M3, forced circulation cooling using the first evaporator 22 shown in FIG. 1 and direct cooling (a direct cooling operation of the freezing compartment) using the second evaporator 23 are performed. That is, the refrigerating compartment 3 and the freezing compartment 4 are cooled by using the first evaporator 22, and the freezing compartment 4 is cooled by using the second evaporator 23.

Specifically, as shown in FIG. 6, first, the control apparatus 30 (referring to FIG. 2) operates the compressor 21 (S40), and compares the temperature in the freezing compartment 4 detected by the F sensor 19 with the set temperature TF to determine whether to cool the freezing compartment 4 (S41).

If the temperature in the freezing compartment 4 is higher than the set temperature TF (S41: yes), the control apparatus 30 switches the three-way valve 25 to the second refrigerant channel B, and inputs the set value F OFF into the option of the set temperature TF (S42). The three-way valve 25 is switched to the second refrigerant channel B. The refrigerant flowing out of the condenser 24 (referring to FIG. 1) is decompressed by the second adjustor 27 (referring to FIG. 1) and then flows into the second evaporator 23. In this way, the freezing compartment 4 is cooled by using the second evaporator 23.

In addition, when the second refrigerant channel B is used, the refrigerant flowing out of the second evaporator 23 flows into the first evaporator 22, and therefore the remaining liquid-state refrigerant may be stored in the first evaporator 22. In this way, the liquid-state refrigerant can be prevented from flowing back to the compressor 21.

Next, the control apparatus 30 measures an elapsed time after the F air door 12 is switched (S43), and further determines whether the elapsed time after the F air door 12 is switched exceeds a specified standard value, that is, a time interval (hereinafter referred to as "time t") for switching the F air door (S44).

If the elapsed time after the F air door 12 is switched reaches the standard time t (S44: yes), the control apparatus 30 determines whether the F air door 12 is open or closed (S45), and if the F air door 12 is closed (S45: yes), resets the elapsed time after the F air door 12 is switched, operates the fan 13 at a low rotational speed, and opens the F air door 12 (S46).

In this way, air in the freezing compartment 4 may circulate to the cooling compartment 8 (referring to FIG. 1), so that cooling is implemented by using the first evaporator 22. As a result, frost can be formed on the first evaporator 22, so that frost on the second evaporator 23 is reduced. In addition, water recycled from the first evaporator 22 may be used to humidify the air in the refrigerating compartment 3.

In another aspect, in step S45, when the F air door 12 is opened (S45: no), the control apparatus 30 resets the elapsed time after the F air door 12 is switched, stops the fan 13, and closes the F air door 12 (S49). In this way, cooling of the freezing compartment 4 by using the first evaporator 22 is stopped, and the freezing compartment 4 is cooled only by using direct cooling of the second evaporator 23. In this way, efficient cooling can be implemented while excessive frost is prevented from forming on the first evaporator 22 and the air in the freezing compartment 4 is prevented from becoming dry.

In addition, in step S44, if the elapsed time after the F air door 12 is switched does not reach the standard time t (S44: no), the control apparatus 30 keeps the F air door 12 open or closed and keeps an operation state of the fan 13.

In this way, during the direct cooling operation of the freezing compartment by using the second evaporator 23, the F air door 12 may be repeatedly opened and closed and the fan 13 may be repeatedly operated and stopped according to the specified time t, so as to prevent the air in the freezing compartment 4 from becoming dry and reduce frost on the first evaporator 22 and the second evaporator 23, so that energy is saved.

Next, the control apparatus 30 enters step S47, measures the cumulative time during which the F air door 12 is kept open, and further measures whether the cumulative time exceeds the time Fmax (S48). When the cumulative time during which the F air door 12 is kept open does not reach the time Fmax (S48: no), the control apparatus 30 returns to step S1 (referring to FIG. 3), and repeats the foregoing control actions. That is, if the cooling load is equal to the specified standard value (FIG. 3, S3: yes), and the temperature in the freezing compartment 4 is higher than the set temperature TF (S41: yes), the direct cooling operation of the freezing compartment by using the second evaporator 23 continues to be performed.

In another aspect, when the cumulative time during which the F air door 12 is kept open exceeds the time Fmax in step S48 (S48: yes), or when the temperature in the freezing compartment 4 is lower than or equal to the set temperature TF in step S41 (S41: no), as shown in FIG. 7, the control apparatus 30 closes the F air door 12, and switches the three-way valve 25 to the first refrigerant channel A. In this way, supply of cold air to the freezing compartment 4 is stopped, and the direct cooling operation of the freezing compartment by using the second evaporator 23 is stopped at the same time.

Next, the control apparatus 30 inputs the set value F ON into the option of the set temperature TF (S51), compares the temperature in the refrigerating compartment 3 detected by the R sensor 18 with the set temperature TR, and determines whether the refrigerating compartment 3 needs to be cooled (S52).

If the temperature in the refrigerating compartment 3 is higher than the set temperature TR (S52: yes), the control apparatus 30 opens the R air door 11, operates the fan 13, and inputs the set value R OFF into the option of the set temperature TR (S53). In this way, cooled air obtained from the first evaporator 22 flows into the refrigerating compartment 3 to cool the refrigerating compartment 3.

The control apparatus 30 then measures the cumulative time during which the R air door 11 is kept open (S54), and further determines whether the cumulative time exceeds the time Rmax (S55). When the cumulative time during which the R air door 11 is kept open exceeds the time Rmax (S55: yes), the control apparatus 30 closes the R air door 11 (S56), resets the cumulative time during which the R air door 11 is kept open, the cumulative time during which the F air door 12 is kept open, and the elapsed time after the F air door 12 is switched (S57), as shown in FIG. 6, returns to step 42, and switches the three-way valve 25 to the second refrigerant channel B.

In this way, switching is performed according to the specified time (the time Fmax, and the time Rmax), and forced circulation cooling of the refrigerating compartment 3 using the first evaporator 22 and direct cooling of the freezing compartment 4 using the second evaporator 23 are alternately performed.

In another aspect, as shown in FIG. 7, in step S55, when the cumulative time during which the R air door 11 is kept open does not exceed the time Rmax (S55: no), the control apparatus 30 returns to step S1 (referring to FIG. 3), repeats the foregoing control actions, and continue to cool the refrigerating compartment 3 by using forced circulation.

In addition, in step S52, if the temperature in the refrigerating compartment 3 is lower than or equal to the set temperature TR (S52: no), the control apparatus 30 closes the R air door 11, stops the fan 13, and inputs the set value R ON into the option of the set temperature TR (S58). In this way, supply of cold air to the refrigerating compartment 3 is cut off.

The control apparatus 30 then compares the temperature in the freezing compartment 4 detected by the F sensor 19 with the set temperature TF (S59), and if the temperature in the freezing compartment 4 is higher than the set temperature TF (S59: yes), returns to step S1, and repeats the foregoing control actions.

In another aspect, if the temperature in the freezing compartment 4 is less than or equal to the set temperature TF (S59: no), the control apparatus 30 stops the compressor 21, and closes the three-way valve 25. In this way, cooling work stops. The control apparatus 30 then returns to the action in step S1.

As discussed above, when the refrigerator 1 is used, forced circulation cooling using the first evaporator 22 and direct cooling using the second evaporator 23 may be combined, so that the frequency of defrosting is reduced, and power consumption is further reduced. In addition, a temperature change can be minimized to prevent food or the like stored in the storage compartment from deteriorating while the air in the refrigerating compartment 3 and the freezing compartment 4 is prevented from becoming dry.

In addition, in the foregoing example, the compressor 21 is operated to cool the refrigerating compartment 3. Here, alternatively, the fan 13 may be operated and the R air door 11 may be opened when the compressor 21 is stopped, and frost on the first evaporator 22 absorbs heat to melt to cool the refrigerating compartment 3. In this way, the power consumption caused by cooling and the power consumption caused by defrosting can be reduced, and more energy can be saved. In addition, water from frost may be used to humidify the air in the refrigerating compartment 3, so as to prevent food in the refrigerating compartment 3 from becoming dry, so that the quality of the food is maintained.

The present invention is not limited to the foregoing embodiments, and various other suitable variations may be made without departing from the scope of the subject of the present invention.

What is claimed is:

1. A refrigerator, comprising:

a storage compartment, at least divided into a refrigerating compartment and a freezing compartment;

a first evaporator, arranged at a cooling compartment, the cooling compartment being connected to the storage compartment through supply air ducts;

a second evaporator, arranged inside the freezing compartment;

a switching valve, used to switch the flow of a refrigerant to a refrigerant channel connected to the second evaporator;

a fan, used to enable cooled air obtained from the first evaporator to flow from the cooling compartment to the storage compartment;

a first air duct damper, inserted in the supply air duct connected to the refrigerating compartment; and a second air duct damper, inserted in the supply air duct connected to the freezing compartment;

a first refrigerant channel, sequentially connecting the switching valve, a first adjustor, and the first evaporator; and a second refrigerant channel, sequentially connecting the switching valve, a second adjustor, the second evaporator, and the first evaporator; wherein the switching valve is used to connect a refrigerant channel on an outlet side of a condenser to the first refrigerant channel or the second refrigerant channel.

2. The refrigerator according to claim 1, comprising a load detector, used to detect a cooling load of the storage compartment, wherein when the cooling load detected by the load detector is less than a specific value, the switching valve is switched to enable the refrigerant to flow to the second evaporator to execute a direct cooling operation of the freezing compartment.

3. The refrigerator according to claim 2, wherein during the direct cooling operation of the freezing compartment, the fan is stopped, and the second air duct damper is closed.

4. The refrigerator according to claim 3, wherein during the direct cooling operation of the freezing compartment, the fan is stopped, and the fan is operated and the second air duct damper is opened after the second air duct damper has been closed for a given time length.

5. A refrigerator, comprising:

a storage compartment, at least divided into a refrigerating compartment and a freezing compartment;

a first evaporator, arranged at a cooling compartment, the cooling compartment being connected to the storage compartment through supply air ducts;

a second evaporator, arranged inside the freezing compartment;

a switching valve, used to switch the flow of a refrigerant to a refrigerant channel connected to the second evaporator;

a fan, used to enable cooled air obtained from the first evaporator to flow from the cooling compartment to the storage compartment;

a first air duct damper, inserted in the supply air duct connected to the refrigerating compartment; and a second air duct damper, inserted in the supply air duct connected to the freezing compartment;

a load detector, used to detect a cooling load of the storage compartment, wherein when the cooling load detected by the load detector is less than a specific value, the switching valve is switched to enable the refrigerant to flow to the second evaporator to execute a direct cooling operation of the freezing compartment;

wherein during the direct cooling operation of the freezing compartment, the fan is stopped, and the second air duct damper is closed.

* * * * *